US006014793A

United States Patent [19]

Howald

[11] Patent Number: 6,014,793

[45] Date of Patent: Jan. 18, 2000

[54] DEVICE FOR ATTACHING THE EXTREMITY OF A LINK TO AN OBJECT, PARTICULARLY A WATCH

[75] Inventor: Michel Howald, Chēne-Bourg, Switzerland

[73] Assignee: Mady's Time Properties LLC, Cheyenne, Wyo.

[21] Appl. No.: 09/091,862

[22] PCT Filed: Dec. 23, 1996

[86] PCT No.: PCT/IB96/01459

§ 371 Date: Jun. 25, 1998

§ 102(e) Date: Jun. 25, 1998

[87] PCT Pub. No.: WO97/24044

PCT Pub. Date: Jul. 10, 1997

[30] Foreign Application Priority Data

Dec. 26, 1995 [FR] France ..... 95 15804

[51] Int. Cl.[7] ..... A44C 5/00

[52] U.S. Cl. ..... 24/265 B; 24/71 J; 24/115 G; 24/265 WS

[58] Field of Search ..... 24/265 B, 265 R, 24/265 WS, 590, 591, 115 G, 71 J, 68 J

[56] References Cited

U.S. PATENT DOCUMENTS

| | | | |
|---|---|---|---|
| 2,807,855 | 10/1957 | Rodriguez . | |
| 3,036,353 | 5/1962 | Minutoli . | |
| 3,550,893 | 12/1970 | Waitzkin | 24/265 R |
| 4,217,681 | 8/1980 | Grohoski et al. | 24/265 B |
| 4,622,723 | 11/1986 | Krauss | 24/115 G |
| 5,313,691 | 5/1994 | Hashimoto | 24/265 WS |
| 5,345,657 | 9/1994 | Shimizu | 24/115 G |
| 5,457,860 | 10/1995 | Miranda | 24/265 B |

*Primary Examiner*—Victor N. Sakran

*Attorney, Agent, or Firm*—Clifford W. Browning; Woodard, Emhardt, Naughton, Moriarty & McNett

[57] ABSTRACT

A device for attaching the end of a strap-like member (14), notably a bracelet, to an object, notably a watch, comprising a housing (1,16,31) provided with two latch pins (3,18,33) adapted to be received in facing recesses of the object. At least one of these pins is able to occupy two positions, a first position in which it protrudes from said housing to come to engage in one of the recesses of the object, and a second position in which it is retracted. A rotatable or push-piece type movable control member (10,20,35) solid with a cam **(10*b*,20*a*,35*b*) engaging with the inner end (39,18*b*,34) of one of the pins (3,18,33) and applied against this cam (10*b*,20*b*,35*b*) by biasing means (14,19,32), can be actuated to bring this pin (3,18,33) into the retracted position against the pressure exerted by the biasing means (4,19,32)**.

21 Claims, 6 Drawing Sheets

DEVICE FOR ATTACHING THE EXTREMITY OF A LINK TO AN OBJECT, PARTICULARLY A WATCH

The present invention relates to a device for attaching the end of a strap-like member, notably a bracelet, to an object, notably a watch, comprising a housing provided with two latch pins adapted to be received in facing recesses of the object, one of these pins being able to occupy two positions, a first position in which it protrudes from said housing to come to engage in one of said recesses of the object, and a second position in which it is retracted, biasing means tending to return this pin into one of these two positions, and a movable control member accessible from outside the housing associated with a cam for moving this pin into the other of said positions against the action of said biasing means.

Such devices are employed principally for attaching the ends of a bracelet to a watch, or of a strap to an article of leatherware, or in the field of jewelry for attaching together the two ends of a bracelet or a necklace. For wrist-watch bracelets, these devices usually include a tubular body called a bar from whose ends two pins (or lugs) protrude for engagement in axially aligned holes that are usually provided in the watchcase horns. For this purpose, at least one of these pins is slidably mounted in the bar and is pushed into its protruding position by a spring housed inside the bar's body. As a result, the operation consisting in securing this device between the watchcase horns necessitates inserting the bar in a loop formed at the end of the bracelet or in a cylindrical passageway of a metallic bracelet, inserting one of the pins into one of the holes in the horns, and then pushing in the other pin against the action of the spring in order to be able to insert it between the horns. Lastly, the end of this pin has to be brought into alignment with the other hole in the horns for it to be pushed therein by the spring.

This operation is not easy to carry out for anyone unfamiliar with it. Because of the pressure exerted by the spring on the pin, the pin often springs out before it can be inserted between the horns. Once the pin has been inserted between the horns, it can still slip out from between the horns and spring out while one is trying to find the location of the hole for receiving the latch pin, which means that the operation has to be started afresh.

Numerous solutions have been proposed to facilitate fitting a bracelet to a watch. In Swiss Patent CH 640 097, it was proposed to control two retractable latch pins by means of a sliding piece acting on two cams, each of the pins being solid with a lever pivoting in a plane through the longitudinal axis of the pin, which moves with a circular, non-sliding movement.

The use of pivoting levers however occupies too much space for the device to be housed in a bar, and necessitates using a housing of much greater volume. As a result, it cannot be housed in a loop at the end of a bracelet in the same way as for a conventional bar.

In U.S. Pat. No. 3,036,353 there has already been proposed a clasp for connecting the two ends of a strap to one another, in which two push-pieces mounted slidably in opposite directions each have a cam engaging with a surface of a locking latch movable perpendicular to the sliding axis of the actuating push-pieces and pressed against these cams by a biasing spring. By pushing the two push-pieces towards one another, this movement is transmitted to the latch which is moved against the action of the biasing spring.

A device for axially moving apart two latch pins of a bracelet is described in U.S. Pat. No. 2,807,855. This device comprises two levers pivoted about a common axis and whose respective ends are elastically applied against the inner ends of the pins by a spring tending to move the arms angularly away from one another. This device has no cam and no means is provided for retracting the pins when it is desired to remove the bracelet from the watch.

In Swiss Patents CH 684 728 and CH 322 135 there have also been proposed bar attachment devices wherein the latch pins cooperating with the horns are directly associated with externally-actuable control means. The systems described in these two documents allow action on the latch pins, without an intermediate cam.

Their drawback resides in the fact that the control member is arranged to be movable along the longitudinal axis of the bar, so that a certain length of the bracelet must be cut away to allow this. Moreover, the insertion of a bar with a protruding non-rectractable lateral control member creates a problem when this bar must be inserted in the loop at the end of the bracelet to be attached.

Another system for rapidly attaching a bracelet is described in Swiss Patent CH 674 291, which shows a bolt sliding in a bar against the pressure exerted by a spring. This bar has a lateral opening through which can be inserted a coupling member having a conical head in order to elastically shift the bolt which then closes and encloses this head. Such an attachment system can only be used with specially designed bracelets and cannot be adapted to a leather bracelet, for example.

An object of the invention is to remedy at least partially the drawbacks of the above-mentioned patents.

To achieve this, the invention concerns a device of the above-mentioned type for attaching a strap-like member to an object, characterized by the fact that the pin able to occupy two positions is slidably mounted along a common axis of the two pins, and the movable control member is solid with said cam engaging with the inner end of one of the pins, which inner end is applied against this cam by said biasing means such that movement of said control member brings this pin into the other of said positions against the pressure exerted by said biasing means.

The attachment device according to the invention is compact and can be used with existing bracelets by making a minor modification thereto, notably by housing the movable control member (rotary or push-piece type) in an opening in the bracelet through which the control member is accessible. In the case of metal bracelets made of articulated links, the device can be housed in one of the links.

If needed, the device comprises locking means for selectively locking the movable control member in at least one given position in order to avoid any unwanted actuation of the control member.

The invention also concerns a strap or strap-like member comprising the device for attaching it to an object, notably a watch, this strap-like member having an opening through which the movable control member—a push-piece or of the rotatable type—protrudes or is accessible.

Lastly, the invention concerns a wrist-watch, an article of jewelry, as well as an article of leatherware, including this device.

Other features of the invention are set out in the dependent claims.

Further advantages will appear form the following description and the accompanying drawings which illustrate, schematically and by way of example, two embodiments and two variations of the attachment device according to the present invention:

Figure 1:
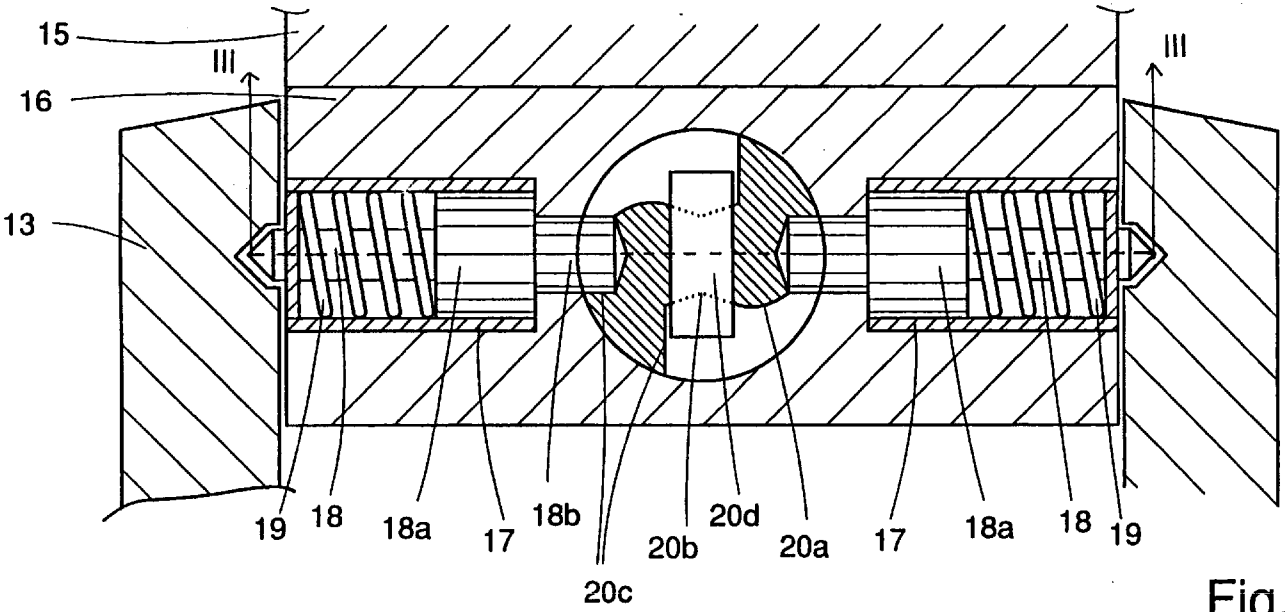
FIG. 1 is a partial plan view, showing the attachment horns of a wrist-watch with a first embodiment of the attachment device.
Figure 2:
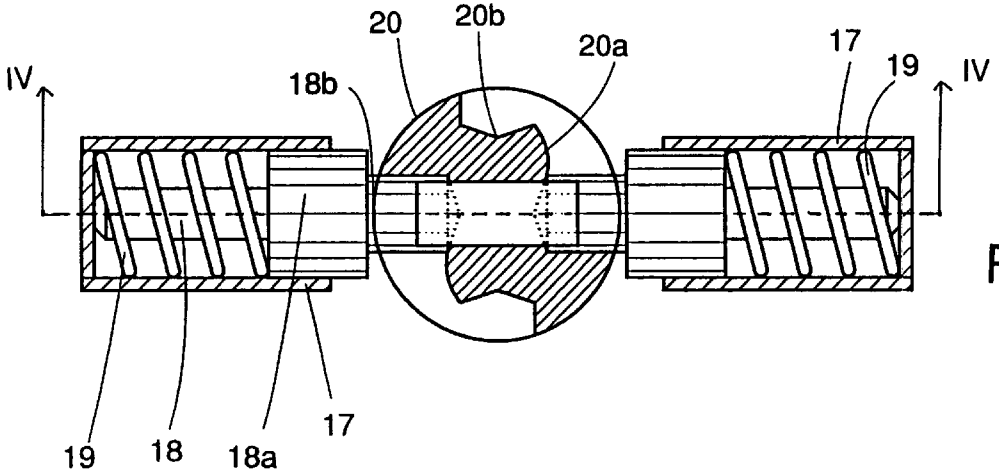
FIG. 2 illustrates the attachment device of FIG. 1, in the disengaged position.

The attachment device illustrated in FIGS. 1 and 2 is most particularly adapted for a metal bracelet made of articulated links 15. Accordingly, the housing in which this device is contained is formed by one of the bracelet's links 16.

Two sleeves 17 are force-fitted in this housing 16, each of the sleeves enclosing a latch pin 18 and a spring 19 pushing a piston-forming portion 18*a* inwardly against a cam 20*a* of a control member 20. The control member 20 of this embodiment is pivotally mounted in the housing 16, about a pivoting axis perpendicular to the sliding axis of the latch pins 18. The cam 20*a* proper terminates at its two ends with a positioning surface 20*b* which receives the conical end of an internal part 18*b* of the latch pin 18. This positioning surface 20*b* is adjacent to a locking surface 20*c* that limits the angle of rotation of the cam 20*a* about its axis of rotation. The two cams 20*a* cooperating with the two latch pins 18 are arranged symmetrically about this axis of rotation. On its external face adjacent the face of the link-housing 16 that normally faces the wearer's arm, the control member 20 includes a slot 20*d* by means of which it can be manipulated.

Figure 3:
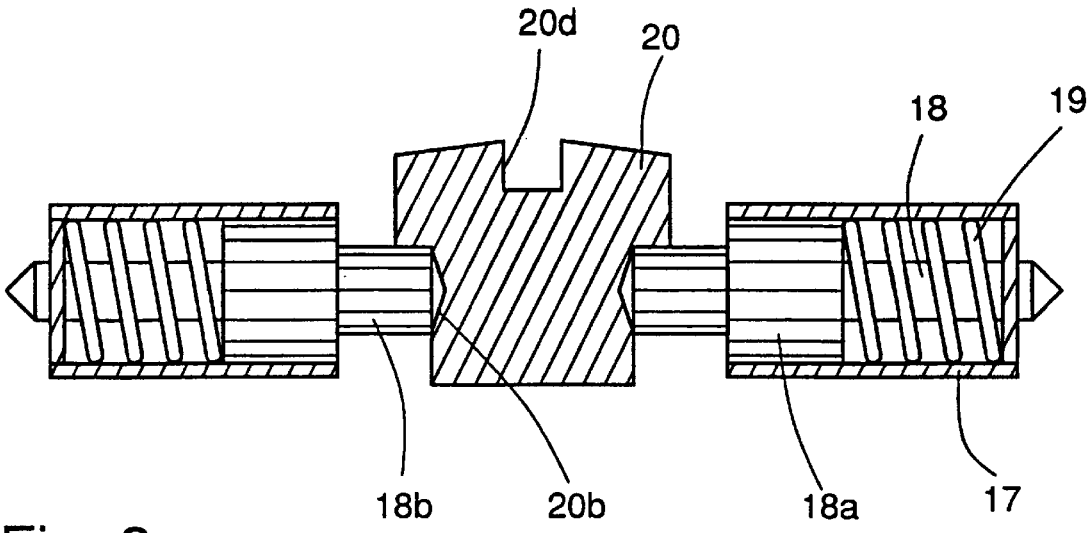
FIG. 3 is a cross-sectional view along line III—III of FIG. 1.
Figure 4:
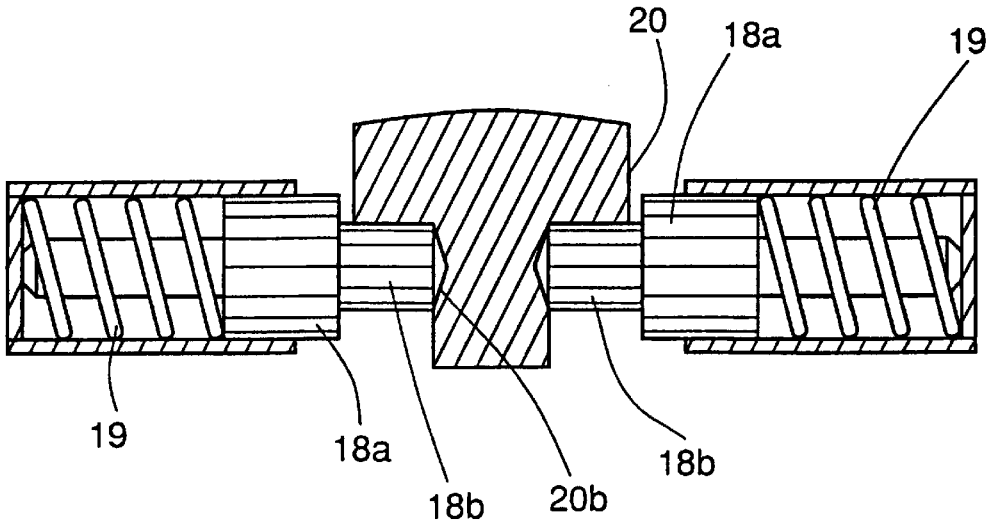
FIG. 4 is a cross-sectional view along line IV—IV of FIG. 2.

FIGS. 1 and 3 illustrate the device with the latch pins 18 protruding out of the link-housing 16, whereas FIGS. 2 and 4 show the same pins 18 retracted in the casing 16.

An advantage of this embodiment is to positively ensure positioning of the latch pins 18 at the two extremities of the cams 20*a*, i.e. in the two angular positions of the control member 20, preventing any accidental release of the bracelet. Moreover, due to this positioning, the control member 20 remains in a stable position both when the latch pins 18 are pushed out of the housing 16 and when they are retracted.

Figure 5:
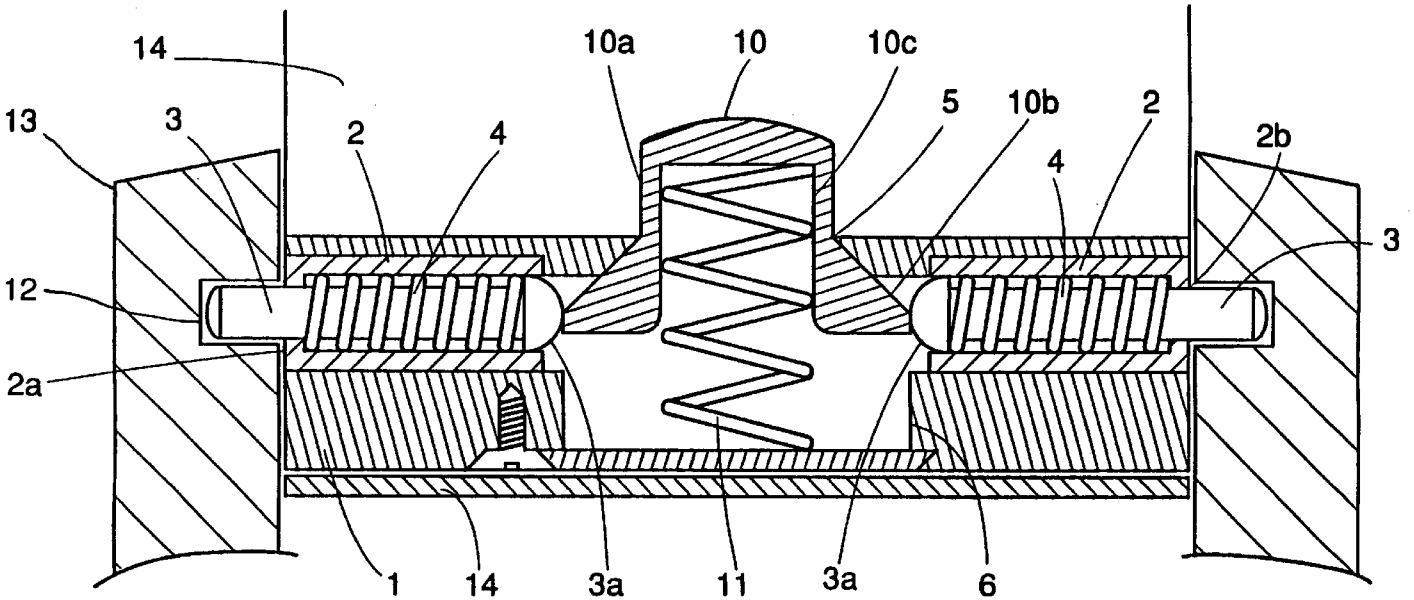
FIG. 5 is a partial plan view similar to FIG. 1, of a second embodiment.
Figure 6:
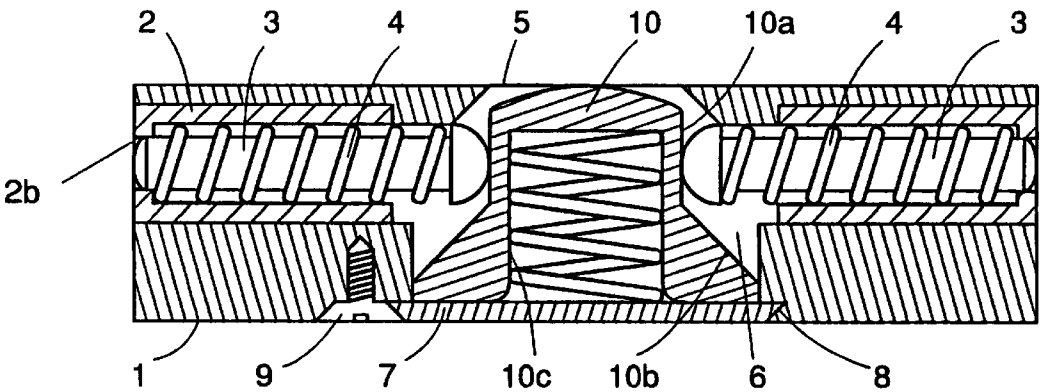
FIG. 6 is a partial cross-sectional view of FIG. 5, showing the attachment device in a disengaged position.

The attachment device of the second embodiment, illustrated in FIGS. 5 and 6, comprises a cylindrical housing 1 having an eccentric longitudinal bore wherein two sleeves 2 are force-fitted at the respective two ends, with their bottom walls 2*a* adjacent to the respective ends of the housing 1. These bottom walls 2*a* each have therein an opening 2*b* allowing the passage of a latch pin 3. The inner end of each pin 3 terminates with a head 3*a*. A coil spring 4 surrounds each pin 3 and bears at one end against a shoulder formed by the head 3*a* and at the other end against the bottom wall 2*a* of sleeve 2.

The housing 1 also has two lateral openings 5 and 6 aligned along a transverse axis perpendicular to the longitudinal axis of the housing 1 and to that of the sleeves 2, the opening 6 having a larger diameter than the opening 5. The opening 6 is closed by a closure plate 7 having a beveled edge engaging in a corresponding dovetail groove 8 extending around the opening 6, and held in place by a conical-headed screw 9 applied against the beveled edge of the closure plate 7.

A control member 10 is slidably mounted along the transversal axis of the openings 5 and 6. It includes a cylindrical part 10*a*, having a diameter allowing it to pass freely through the opening 5, followed by a conical part 10*b* whose base diameter allows it to pass freely through the opening 6. This member 10 includes a cylindrical housing 10*c* which opens into the base of the conical part 10*b* and contains a coil spring 11 that bears on the one hand against the bottom of this housing 10*c*, and on the other hand against the closure plate 7, thereby pushing the control member 10 through the opening 5 until the conical part 10*b* abuts against the edge of opening 5.

The two heads 3*a* of the latch pins 3 are pushed by the respective springs 4 against this control member 10 whose external surface 10*a*,10*b* acts as a cam. As illustrated in FIGS. 5 and 6, when the control member is in the rest position (FIG. 5), the spring 11 pushes it out and the conical part 10*b* in turn pushes the latch pins 3 outwards. This is the position of the components of the device wherein the bracelet is fixed in the corresponding openings 12 of the watchcase horns 13. When a pressure is exerted on the end of the control member 10 to push it into the housing 1 (FIG. 6), the pins' heads 3*a* pass from the conical part 10*b* to the cylindrical part 10*a* of the control member 10, thus being withdrawn into the housing to permit the attachment device to be removed or placed in position.

To attach a bracelet 14 to the horns 13 of a watch (not shown), the attachment end for instance of a leather bracelet or similar bracelet includes a part folded over on itself to form a loop in which the housing 1 is inserted like a conventional bar. To enable manipulation of the control member 10, the bracelet 14 is punched with a hole allowing access to this member.

The variant illustrated in FIGS. 7 to 10 aims principally to prevent the bracelet from being released by an accidental pressure on the push-piece 10. It comprises a housing 31 comprising a central part 31*a* constituted of a circular casing, and two coaxial tubular parts 31*b* extending radially from either side of the central part 31*a*, force-fitted in two diametral openings thereof. The external ends of the tubular parts 31*b* each form a shoulder 31'*b* serving as abutment for a biasing spring 32 coiled around a sliding pin 33 whose inner end terminates with a hemispherical head 34 forming a second shoulder against which the other end of the spring 32 bears. Consequently, the pins 33 are pressed against a conical cam 35*b* provided on the inner end of a push button 35 movable along an axis perpendicular to the axis of pin 33. Apart from the cam 35*b*, this push-button 35 has a generally cylindrical body and passes through an opening 37 provided in one of the end faces of the circular casing that forms the central part 31*a* of housing 31. A spring 36, which bears against the inner face of a cover 38 screwed in the circular casing 31*a* to form its second end face, elastically holds the push-button 35 in the position shown in FIG. 7, the path of the push-button 35 being limited by cam 35*b*.

Figure 7:
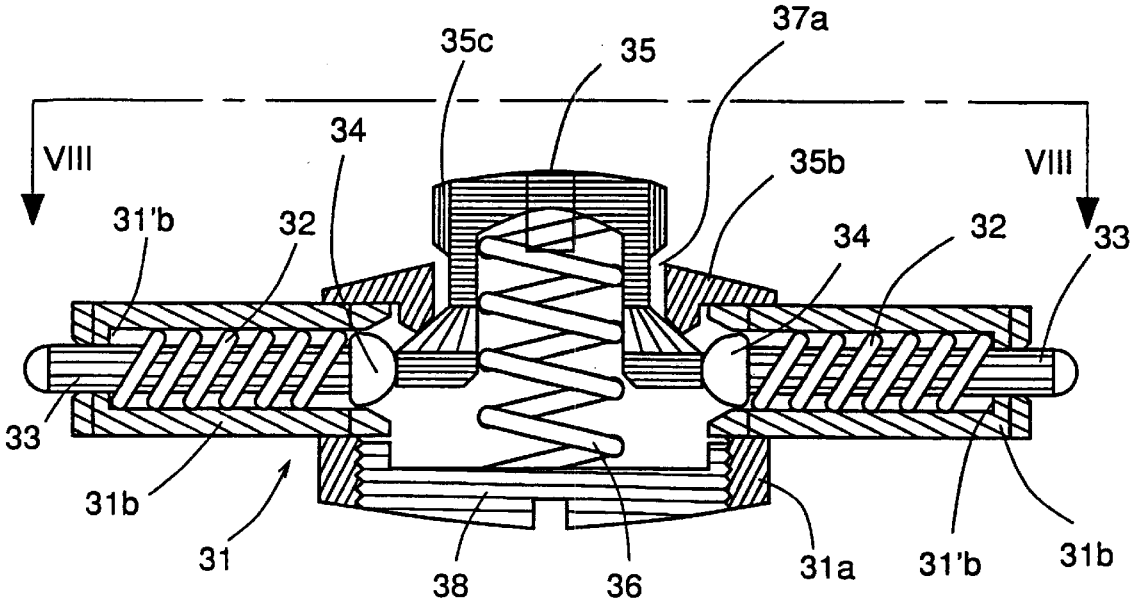
FIG. 7 is a view similar to FIG. 5 of a varied embodiment.
Figure 8:
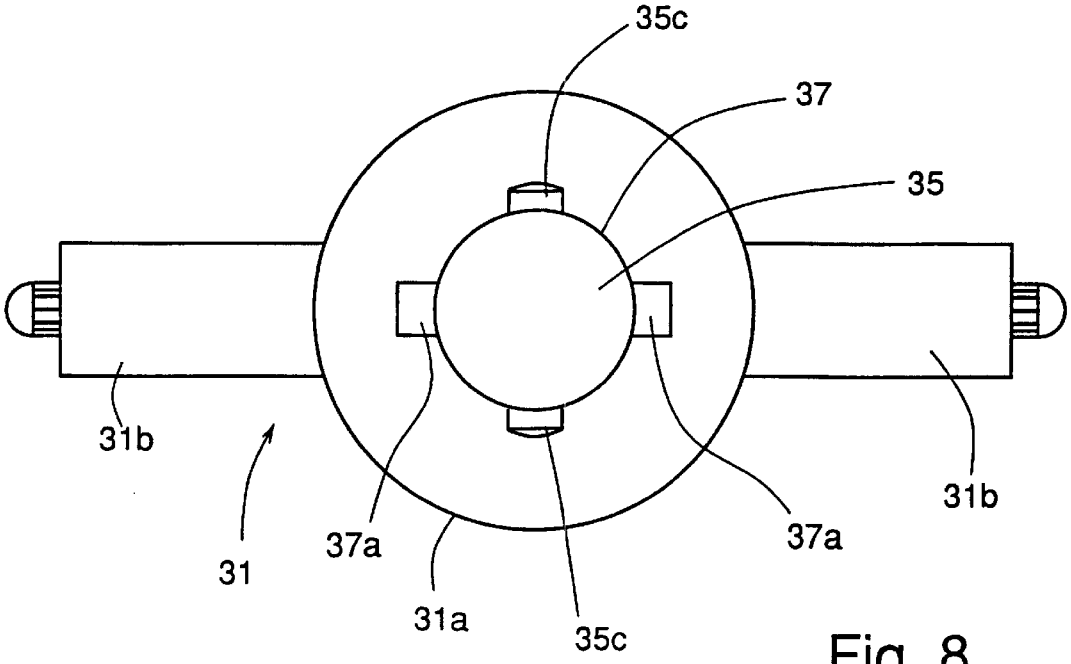
FIG. 8 is a view along line VIII—VIII of FIG. 7.
Figure 9:
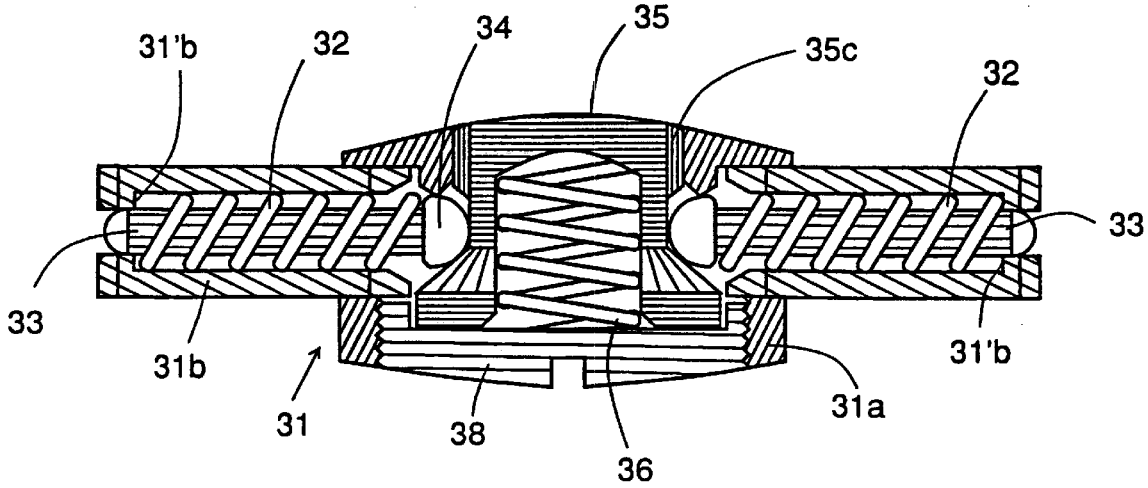
FIG. 9 is a view of the variant of FIG. 7 in the disengaged position.
Figure 10:
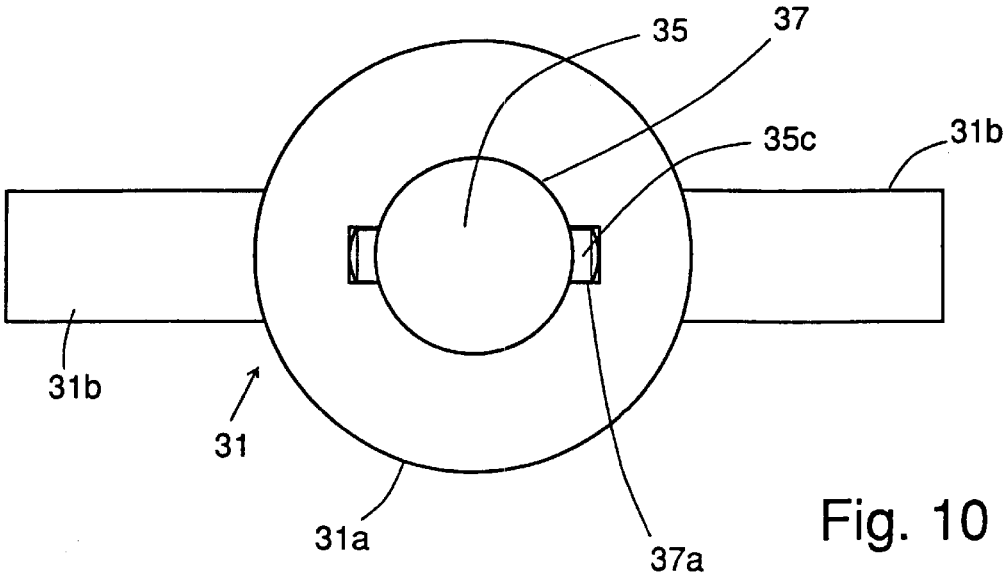
FIG. 10 is a view along line X—X of FIG. 9.

As can be seen in FIGS. 7 and 8, the cylindrical part of the push-button 35, which normally protrudes from the central part 31*a* of the housing, includes two diametrically opposed abutments 35*c* which project radially from the cylindrical surface of the push-button 35. The opening 37 in which this push-button 35 is slidably mounted includes therein two diametrically opposed recesses 37*a* dimensioned to be able to receive the abutments 35*c*. If the angular position of the abutments 35*c* does not coincide with that of the recesses 37*a*, the push-button cannot be pressed in the central casing 51*a*, whereby the pins 33 cannot be retracted so the bracelet remains held in place.

The purpose of the abutments 35*c* is to prevent unwanted disengagement of the pins 33 from the watches horns, for example. Once the bracelet has been attached by means of the device of FIGS. 7 to 10, it suffices to turn the push-button 35 by a given angle (FIG. 8) in the opening 37 to prevent any accidental actuation and consequently any unwanted removal of the bracelet from the member to which it is secured.

Figure 11:
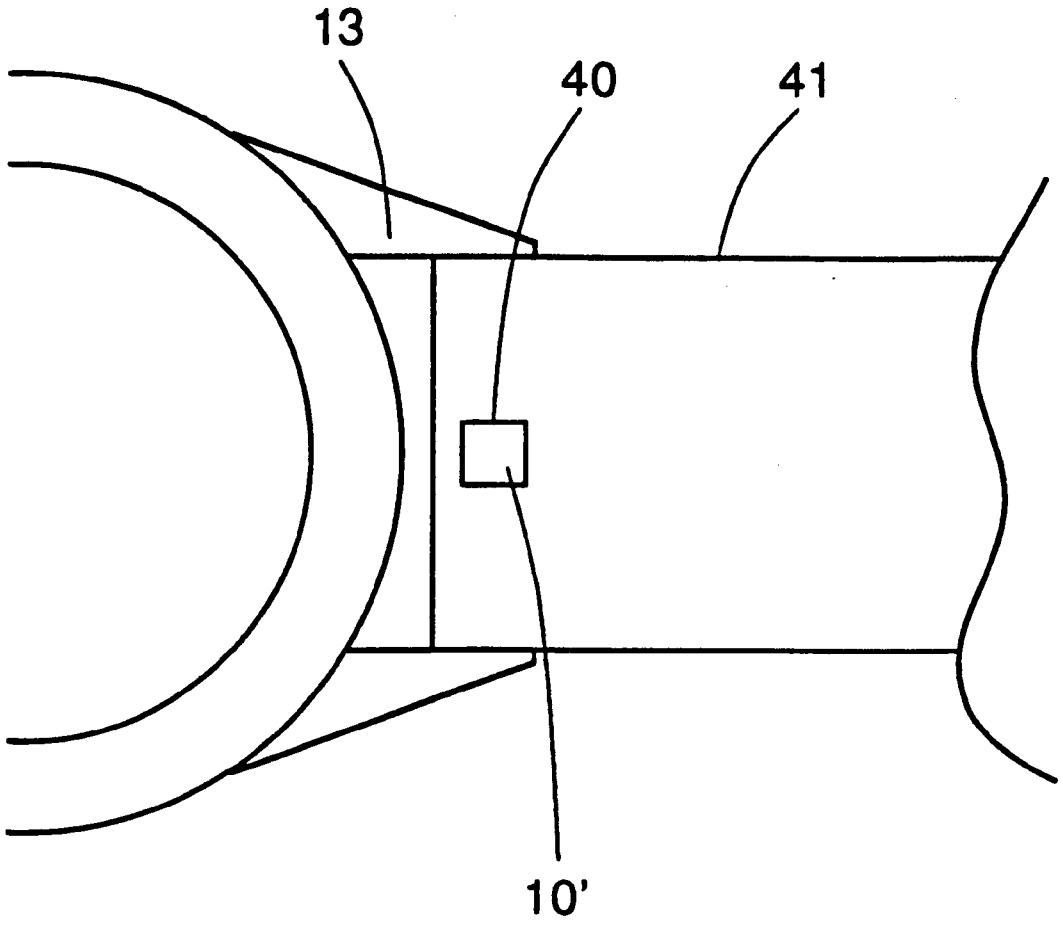
FIG. 11 is a partial view of a wrist-watch casing with another variation of the device of FIG. 5.

FIG. 11 illustrates a device similar to that of FIG. 5, wherein the push-button 10' has a non-circular cross-section, for example square. Even though this actuating member 10' cannot turn in the opening 40', it is possible to arrange that the length of its part which projects laterally from the cylindrical housing is about equal to the thickness of bracelet 41. In this way, it is not possible to accidentally actuate the push-button 10' because it has to be pushed in below the level of the bracelet. Of course, it would also be possible to associate locking means with the push-button 10'.

It should be noted that this push-button 10' of FIG. 11 may be situated underneath or above the bracelet. This remark applies also to the embodiment of FIGS. 1 to 4. When the push-button is above the bracelet, it is possible to provide the control member 10,20 with a decorative appearance, either due to its own shape, or by fitting a decorative piece.

The above description has more particularly concerned use of the device according to the invention for the attachment of a bracelet to a watchcase, but it is evident that this device can be used for attaching any strap-like member to an object, such as a strap to a bag or another article of leatherware, for example. It is also possible to use this device in jewelry, for instance to join together the two ends of a bracelet or of a necklace, in which case the device acts as a clasp.

In the case of the first above-described embodiment with a rotating control member, the slot 21 could be replaced by a protruding gripping member visible on the outside of the bracelet, enabling the control member to be manipulated by hand without using a tool.

Also, as a variation, only one of the two latch pins need be slidably mounted, the other being solid with the housing. In this case, the control member need only have one cam 20*a* in the example of the embodiment illustrated by FIGS. 1 to 4. In the second embodiment, even if the conical part acts as two cams, this conical part is the only surface of revolution and it suffices to ensure that the fixed pin is out of the trajectory of this frusto-conical part. Moreover, this fixed pin could be directly made as an integral part of the housing itself.

It is self-evident that the embodiment of FIGS. 1 to 4 could also be used to attach a bracelet of leather or plastics. Likewise, the usefulness of the embodiment of FIGS. 5 to 10 is not confined to leather or plastic bracelets, but it could be appropriately adapted to a metal bracelet.

While the locking means have been shown associated with a push-button 35, locking means could also be associated with the rotatable control member 20 even though the risk of accidental actuation of this member is unlikely. However, when this member is designed to be manually actuated, without using a tool, as mentioned previously, such a locking may be useful.

I claim:

1. A device for attaching the end of a strap-like member to an object, comprising a housing (1, 16, 31) provided with two latch pins (3, 18, 33) adapted to be received in facing recesses of the object, one of these pins being able to occupy two positions, a first position in which it protrudes from said housing to come to engage in one of said recesses of the object, and a second position in which it is retracted, biasing means (4, 19, 32) tending to return this pin into one of these two positions, and a movable control member (10, 20, 35) accessible from outside the housing (1, 16, 31) associated with a cam (10*b*, 20*a*, 35*b*) for moving this pin (3, 18, 33) into the other of said positions against the action of said biasing means (4, 19, 32), characterised by the fact that the pin (3, 18, 33) able to occupy two positions is slidably mounted along a common axis of the two pins (3, 18, 33), and the movable control member (10, 20, 35) is solid with said cam (10*b*, 20*a*, 35*b*) engaging with the inner end (39, 18*b*, 34) of one of the pins (10*b*, 20*b*, 35*b*), which inner end is applied against this cam (10*b*, 20*b*, 35*b*) by said biasing means (14, 19, 32) such that movement of said control member (10, 20, 31) brings this pin (3, 18, 33) into the other of said positions against the pressure exerted by said biasing means (4, 19, 32).

2. The attachment device according to claim 1, characterized by the fact that it includes locking means (35*c*,37) for locking said movable control member (10,20,35) in at least one given position.

3. The attachment device according to claim 1 or 2, characterized by the fact that the two pins (3,18,33) are slidably mounted in said housing (1,16) and the movable control member (10,20,35) is made with integral cam surfaces (10*b*,20*b*,35*b*) symmetrically distributed relative to the axis of movement of this movable control member and in engagement with the respective internal ends of said pins (3,18,33).

4. The attachment device according to claim 1, characterized by the fact that said housing (31) includes two tubular elements (31*b*) in which said pins (33) are mounted, and extending along a common axis starting from a central element (31*a*) in which said push-piece (35) is mounted.

5. The attachment device according to claim 1, characterized by the fact that said movable control member is associated with an added decorative element.

6. The attachment device according to claim 1, characterized by the fact that said movable control member (20) is constituted by a member rotatably mounted in a cylindrical housing extending in said housing (16) perpendicular to the sliding axis of said latch pin (18).

7. The attachment device according to claim 6, characterized by the fact that two abutments (20*c*) limit the angular displacement of said movable control member (20) between two positions corresponding to the two respective positions of said pin (18).

8. The attachment device according to claim 6, characterized by the fact that positioning means (20*b*) are arranged on either side of said cam (20*a*) to retain said control member (20) in one or the other of said angular positions.

9. The attachment device according to claim 1, characterized by the fact that said movable control member (10,35) is constituted by a push-piece movable along an axis perpendicular to the sliding axis of said pin (3,32), said cam being solid with the internal end of this push-piece.

10. The attachment device according to claim 9, characterized by the fact that a spring (11,36) is arranged between this push-piece (10-35) and said housing (1,31*a*) tending to constantly hold the push-piece (10,35) protruding out of a lateral opening (5,37) of this housing (1,31*a*), said cam (10*b*,35*b*) limiting the displacement of said push-piece out of the housing (1,31*a*) by coming to bear against the edge of this lateral opening (5,37).

11. The attachment device according to claim 9, characterized in that said push-piece (35) comprises a generally cylindrical body whereof the part normally protruding from the exterior of said housing has at least one abutment member (35*c*) protruding radially from the cylindrical surface of said body, the section of said lateral opening (37) corresponding to the transversal section of said push-piece level with said abutment (35*c*), in a manner to allow displacement of said push-piece (35) only in a position where the section of said opening (37) and that of said push-piece (35) adjacent to the level of said abutment coincide angularly.

12. The attachment device according to claim 9, characterized by the fact that said housing (1) has a substantially cylindrical shape, the common axis along which at least one of said pins (3) is slidably mounted being parallel to the longitudinal axis of said housing (1), and the lateral opening (5) provided in said housing (1) to allow passage of said push-piece (10) being provided at the location where the wall of the cylindrical housing (1) is thinnest, whereas a cylindrical passageway (6) is provided in the thicker part of this wall facing said opening (5), and serves to guide said cam (10*b*) solid with this push-piece (10), a removable closure member (7) closing the external end of this passageway (6) and serving as bearing surface for the spring (11) associated with said push-piece (10).

13. A strap-like member, notably a bracelet, comprising a device according to claim 1 for attaching the strap-like member to an object, notably a watch, this strap-like member (41) having an opening (40) through which said movable control member (10,20,35) projects or is accessible.

14. A strap-like member according to claim 13, in the form of a metal bracelet with links (15), characterized by the fact that the two latch pins (18,33) and the movable control member (10,20,35) are housed in a link (16) of the metal bracelet.

15. A strap-like member according to claim 13, in the form of a flat strap (14) comprising a loop formed by folding over at least a part of the thickness of the end of this flat strap on itself, characterized by the fact that said housing is lodged in said loop, said opening of the strap being arranged facing the opening of the housing (1) through which said movable control member (10) is accessible.

16. A strap-like member according to claim 13, characterized by the fact that said push-piece (10') normally protrudes from said housing by an amount which corresponds substantially to the thickness of a portion of the strap-like member that partly surrounds said housing, in a manner to be able to contain the protruding part of the push-piece (10) in the thickness of said strap-like member.

17. The device of claim 1 in which the object is a wrist watch.

18. The device of claim 1 in which the object is an article of jewelry.

19. The device of claim 1 in which the object is an article of leatherwear.

20. A device for attaching the end of a strap-like member, notably a bracelet, to an object, notably a watch, comprising a housing (1, 16, 31) provided with two latch pins (3, 18, 33) adapted to be received in facing recesses of the object, one of these pins being able to occupy two positions, a first position in which it protrudes from said housing to come to engage in one of said recesses of the object, and a second position in which it is retracted, biasing means (4, 19, 32) tending to return this pin into one of these two positions, and a movable control member (10, 20, 35) accessible from outside the housing (1,16, 31) associated with a cam (10*b*, 20*a*, 35*b*) for moving this pin (3,18, 33) into the other of said positions against the action of said biasing means (4, 19, 32), characterized by the fact that the pin (3,18, 33) able to occupy two positions is slidably mounted along a common axis of the two pins (3, 18, 33), and the movable control member (10, 20, 35) is solid with said cam (10*b*, 20*a*, 35*b*) engaging with the inner end (39, 18*b*, 34) of one of the pins (10*b*, 20*b*, 35*b*) which inner end is applied against this cam (10*b*, 20*b*, 35*b*) by said biasing means (14, 19, 32) such that movement of said control member (10, 20, 31) brings this pin (3, 18, 33) into the other of said positions against the pressure exerted by said biasing means (4,19, 32), characterized by the fact that said movable control member (10, 35) is constituted by a push-piece movable along an axis perpendicular to the sliding axis of said pin (3, 32), said cam being solid with the internal end of this push-piece, and characterized in that said push-piece (35) comprises a generally cylindrical body whereof the part normally protruding from the exterior of said housing has at least one abutment member (35*c*) protruding radially from the cylindrical surface of said body, the section of said lateral opening (37) corresponding to the transversal section of said push-piece level with said abutment (35*c*), in a manner to allow displacement of said push-piece (35) only in a position where the section of said opening (37) and that of said push-piece (35) adjacent to the level of said abutment coincide angularly.

21. A device for attaching the end of a strap-like member, notably a bracelet, to an object, notably a watch, comprising a housing (1, 16, 31) provided with two latch pins (3, 18, 33) adapted to be received in facing recesses of the object, one of these pins being able to occupy two positions, a first position in which it protrudes from said housing to come to engage in one of said recesses of the object, and a second position in which it is retracted, biasing means (4, 19, 32) tending to return this pin into one of these two positions, and a movable control member (10, 20, 35) accessible from outside the housing (1, 16, 31) associated with a cam (10*b*, 20*a*, 35*b*) for moving this pin (3, 18, 33) into the other of said positions against the action of said biasing means (4, 19, 32), characterized by the fact that the pin (3, 18, 33) able to occupy two positions is slidably mounted along a common axis of the two pins (3, 18, 33), and the movable control member (10, 20, 35) is solid with said cam (10*b*, 20*a*, 35*b*) engaging with the inner end (39, 18*b*, 34) of one of the pins (10*b*, 20*b*, 35*b*) which inner end is applied against this cam (10*b*, 20*b*, 35*b*) by said biasing means (14, 19, 32) such that movement of said control member (10, 20, 31) brings this pin (3, 18, 33) into the other of said positions against the pressure exerted by said biasing means (4, 19, 32), characterized by the fact that said movable control member (10, 35) is constituted by a push-piece movable along an axis perpendicular to the sliding axis of said pin (3, 32), said cam being solid with the internal end of this push-piece, and characterized by the fact that said housing (1) has a substantially cylindrical shape, the common axis along which at least one of said pins (3) is slidably mounted being parallel to the longitudinal axis of said housing (1), and the lateral opening (5) provided in said housing (1) to allow passage of said push-piece (10) being provided at the location where the wall of the cylindrical housing (1) is thinnest, whereas a cylindrical passageway (6) is provided in the thicker part of this wall facing said opening (5), and serves to guide said cam (10*b*) solid with this push-piece (10), a removable closure member (7) closing the external end of this passageway (6) and serving as bearing surface for the spring (11) associated with said push-piece (10).

* * * * *